United States Patent [19]

Nogaki

[11] Patent Number: 4,821,456

[45] Date of Patent: Apr. 18, 1989

[54] LINEAR MECHANICAL DRIVE WITH PRECISE END-OF-TRAVEL LOAD POSITIONING

[76] Inventor: Hisami Nogaki, 6465 E. Camino Grande, Anaheim Hills, Calif. 92807

[21] Appl. No.: 189,102

[22] Filed: May 2, 1988

[51] Int. Cl.[4] ..... E05F 11/34

[52] U.S. Cl. ..... 49/362; 74/424.8 R; 74/89.15; 49/199

[58] Field of Search ..... 49/362, 280, 199, 200; 160/188, 189; 74/424.8 R, 89.15; 192/141

[56] References Cited

U.S. PATENT DOCUMENTS

| | | | |
|---|---|---|---|
| 1,139,905 | 5/1915 | Pitts | 49/362 X |
| 2,951,390 | 9/1960 | Martens et al. | 49/362 X |
| 3,533,298 | 10/1970 | Gerber | 74/424.8 R X |
| 3,996,697 | 12/1976 | Bailey et al. | 49/362 X |
| 4,107,877 | 8/1978 | Lee | 49/362 X |
| 4,121,636 | 10/1978 | James | 74/424.8 R X |
| 4,147,073 | 4/1979 | Mercier | 74/424.8 R X |
| 4,310,144 | 1/1982 | Nogaki | 74/424.8 R X |

*Primary Examiner*—Philip C. Kannan
*Attorney, Agent, or Firm*—Natan Epstein

[57] ABSTRACT

A linear mechanical drive with precise end of travel load positioning includes a drive shaft having a threaded portion intermediate two non-threaded portions, reversible motor drive turning the shaft, a load carrier element threaded on the shaft for pulling the load along the shaft, the carrier disengaging at the non-threaded portions thereby to precisely determine the end position of the carrier irrespective of continued drive shaft rotation. The carrier reengages to the threaded portion upon reversal of drive shaft rotation, and a load connector on the carrier element is adjustable for precisely positioning the load at one or both of the end of travel positions. Other features disclosed protect the drive against excessive mechanical wear and disengage the load from the carrier element for strain relief.

20 Claims, 3 Drawing Sheets

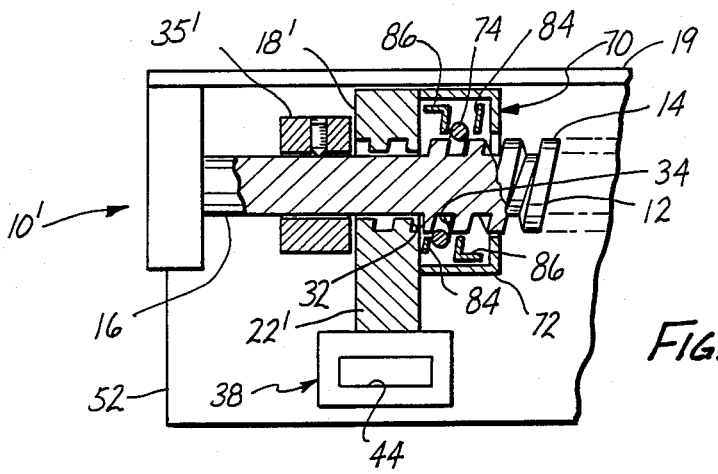
FIG. 7
FIG. 8
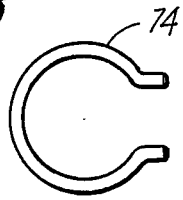
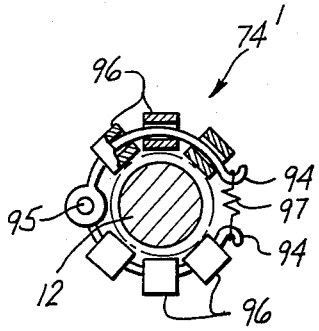
FIG. 9
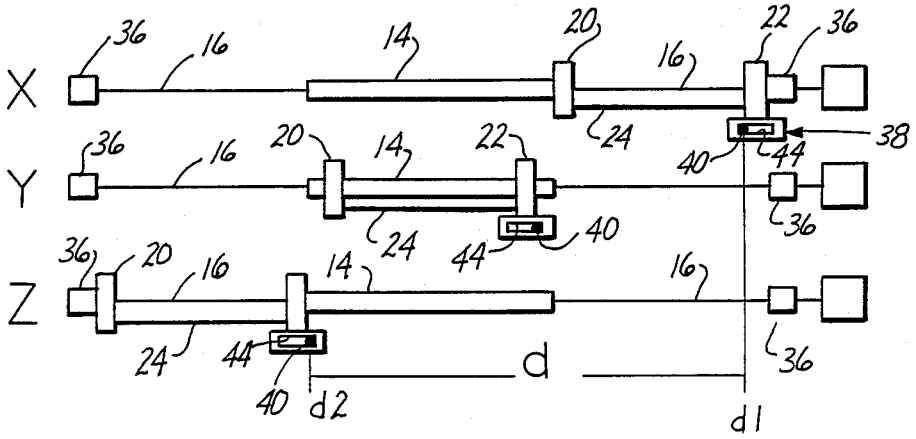
FIG. 10

LINEAR MECHANICAL DRIVE WITH PRECISE END-OF-TRAVEL LOAD POSITIONING

BACKGROUND OF THE INVENTION

1. Field of the Invention

The present invention pertains generally to the field of mechanical drive systems capable of moving a load back and forth between two end-of-travel positions such as for example, a door or gate actuating systems and more particularly relates to such a linear drive featuring a motor driven threaded drive shaft and a load pulling carrier assembly axially displaceable by rotation of the shaft. The novel drive is characterized by precise positive end-of-travel positioning of the load along the shaft by purely mechanical means irrespective of continued shaft rotation to thereby eliminate previously used timers and position sensors.

2. State of the Prior Art

Linear mechanical drives find wide application but are particularly in opening and closing doors and sliding gates such as remotely operated garage doors.

One particular application for screw drives of the type contemplated by this invention has been in the remote actuation of roll-up type truck loading doors on cargo van and trailer truck doors. Roll-up doors are made of several panels hinged together along their horizontal edges and held along their sides within slide tracks which are vertical along the door opening for holding the hinged panels in a flat vertical plane to close the door opening. The slide tracks curve to a horizontal position above the door opening such that pushing up on the door successively brings the panels to a horizontal out of the way position. Conventionally, such door actuating drives have included a worm gear or screw shaft mounted to the ceiling of the van/trailer cargo enclosure and driven by a reversible motor powered by the vehicle battery. A nut is threaded on the worm screw and is displaced axially by rotation of the screw. A load such as a van pull-up door is connected to and pulled by the nut between the opposite ends of the threaded drive shaft. This general type of linear drive is well known and widely used in many applications. Difficulties have been encountered, however, in applications requiring precise positioning of the load at one or both ends of the drive shaft. Rotary inertia of the drive motor introduces a positioning error in systems relying on timers or load position sensors to activate and deactivate the motor. More sophisticated systems capable of electronically sensing and accurately positioning the load are costly and require more complex installation wiring of the system. In many applications such as truck door and garage door actuators, it is desirable to minimize the cost and complexity of the system without, however, sacrificing reliability. A continuing need exists for simple drive systems capable of long term reliability and load positioning accuracy with minimal maintenance, particularly in difficult environments such as cargo compartments of transport vehicles where the drive system is exposed to severe vibration, shock, ambient temperature extremes, humididty and moisture.

SUMMARY OF THE INVENTION

The present invention is a mechanical linear drive featuring a number of improvements over previously known systems of this type. The improvements, which may be implemented individually or in various combinations in a particular linear drive, provide adjustable and repeatably precise end-of-travel load positioning, gear thread protection to avoid long term deterioration in drive accuracy and performance due to thread wear, a delayed load engagement feature which permits the drive motor to reach full torque before the load is applied to the motor drive, and a self-actuating load relief feature which automatically transfers the load to the structure which supports the shaft drive itself such as a truck van/trailer enclosure or a garage building structure. The weight of the load is thus borne by the surrounding structure while the load is at one or both of its end-of-travel positions thus relieving both the load carrier and the drive shaft from this load except while the system is being operated to actually move the load.

More specifically, the invention is a linear mechanical drive which includes a drive shaft having a threaded shaft section intermediate two non-threaded shaft end sections. The drive shaft is mounted to a supporting structure and is turned by a reversible motor drive. A threaded load carrier assembly including a load connecting rod is axially displaceable along the drive shaft from one to another of the two non-threaded shaft portions in response to rotation of the drive shaft. The carrier assembly disengages from the threaded shaft section at each of the non-threaded sections and positively stop axial movement upon such disengagement to thereby mechanically precisely determine the end-of-travel positions of the carrier and load connected to the same irrespective of continued drive shaft rotation. The load carrier is brought into re-engagement with the threaded shaft section either by means of a bias spring mounted on the non-threaded shaft section, or by a thread follower unit which is attached to the load carrier assembly and remains in an engagement with the shaft thread. The thread follower unit yields to shaft rotation tending to drive the load carrier away from the threaded section, while positively engaging the shaft thread upon reverse shaft rotation tending to bring the carrier assembly into threading re-engagement with the threaded shaft section. This thread follower unit may be employed instead of or in combination with the aforementioned bias spring. The thread follower unit also maintains the load carrier spaced from the shaft threading against the urging of the return bias spring to prevent frictional wear of the thread ends on both the shaft and the carrier due to continued rotation of the shaft after the carrier has disengaged.

The load carrier assembly may be a single threaded element but preferably consists of two axially connected threaded segments or nuts, the load connecting rod being attached to one of these segments. The axial spacing between the two carrier segments is variable by means of threaded connectors so as to vary the effective length of the carrier assembly and thereby adjust the end-of-travel position of the load connecting rod at least at one of its end-of-travel positions on the drive shaft.

The load connecting rod is loosely coupled to the carrier assembly so as to delay positive engagement between the load and the carrier until after the carrier has re-engaged with the threaded shaft section and the drive motor has built up to full torque. At least one of the two carrier segments has its threading defined on a cylindrical nut which is rotatable relative to the second carrier segment so as to allow matching of the thread of the two carrier segments whenever the axial spacing between the two segments is adjusted thereby to match the drive shaft thread.

The self-actuating load relief mechanism comprises an interlock arrangement for engaging the load to the structure supporting the drive mechanism at one or both end-of-travel positions thereby to relieve the load carrier and drive shaft of the load while at the end-of-travel position.

The load relief mechanism includes a locking pin on the load carrier biased towards engagement with a stationary element secured to the drive supporting structure such as a wall of the drive housing. The load carrier includes a releasing pin operative for disengaging the locking pin upon movement of the carrier towards reengagement with the threaded shaft section, and a slot defined in the load carrier assembly for delaying operative engagement between a load connecting rod and the load carrier carrier until after disengagment of the locking pin and reengagement of the carrier with the threaded shaft section. The delay also allows the drive motor to reach full torque before coming under load.

These and other advantages and improvements of this invention will be better understood from the following detailed description and accompanying drawings.

BRIEF DESCRIPTION OF THE DRAWINGS

FIG. 7 illustrates an obtional thread follower unit attached to a single element load carrier;

FIG. 8 shows a C-spring or split ring spring used in the thread follower unit of FIG. 7.

FIG. 9 shows partly in section a circumferentially expandable ball bearing arrangement used in the thread follower of FIG. 7 alternatively to the FIG. 8 spring;

FIG. 10*x* schematically illustrates the carrier and load coupler positioning at the right hand end-of-travel position;

FIG. 10*y* schematically illustrates the carrier and load coupler positioning at an intermediate point during travel towards the left hand end-of-travel position;

FIG. 10*z* schematically illustrates the carrier disengaged at its left hand end-of-travel position;

DETAILED DESCRIPTION OF THE PREFERRED EMBODIMENTS

Figure 1:
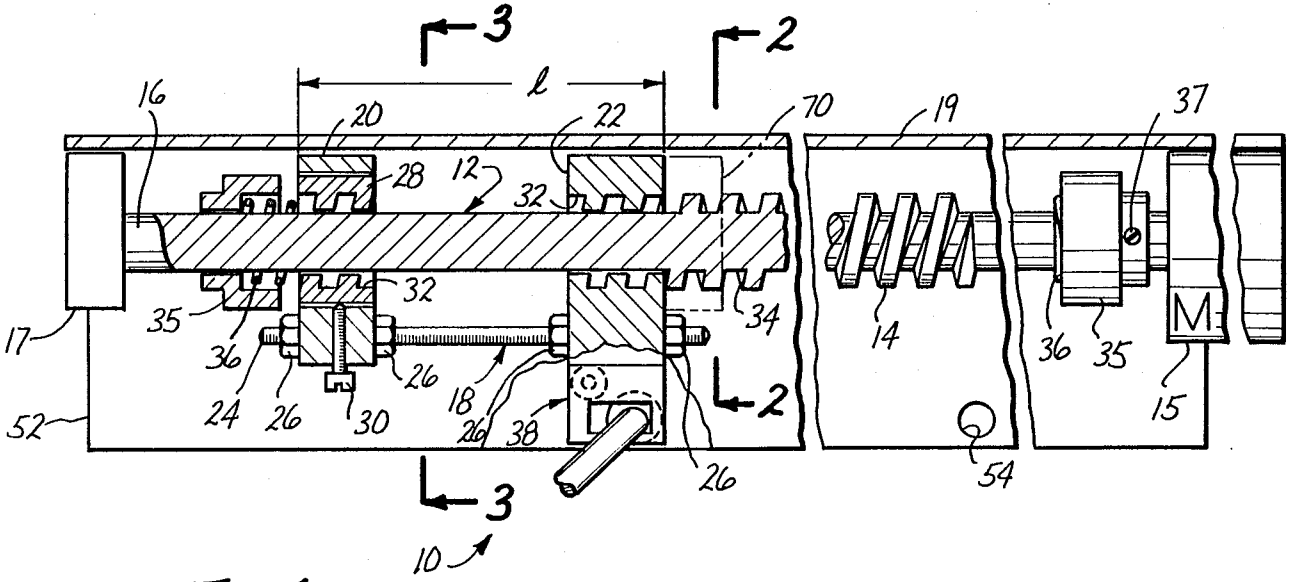
FIG. 1 is a longitudinal view partly in section of a linear mechanical drive according to this invention.
Figure 3:
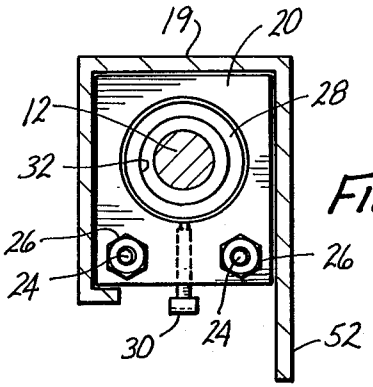
FIG. 3 is an axial cross-section taken along line 3—3 in FIG. 1.
Figure 2:
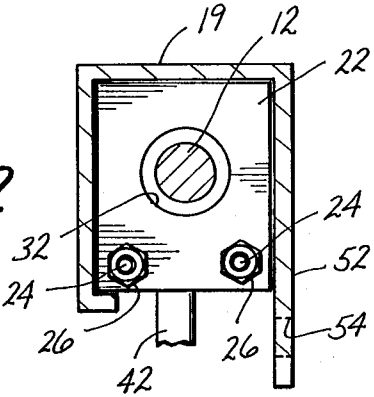
FIG. 2 is an axial cross-sectional view taken along line 2—2 in FIG. 1.

With reference to the drawings, FIGS. 1, 2 and 3 show the linear drive 10 comprising a drive shaft 12 coupled at one end to a drive motor 15, and supported by the motor 15 and an end bearing 17 to a channel-like drive housing 19 which is shown in transverse cross section in FIGS. 2 and 3. The drive shaft 12 has a threaded shaft section 14 intermediate two non-threaded end sections 16. A load carrier assembly 18 includes two carrier segments 20, 22, connected in axially spaced relationship by two threaded adjustment shafts 24. The axial spacing of the two segments 20, 22 along the shaft 24 is fixed by means of nuts 26 threaded on the adjustment shafts 24. The carrier segment 20 includes a cylindrical nut 28 held rotatably within the carrier segment 20 as better seen in the end view of FIG. 3. The nut 28 is normally fixed to the first carrier segment 20 by means of a set screw 30 but may be released for rotation so as to match the threading 32 of the nut 28 to the shaft threading 34 relative to the threading 32 of the second carrier segment 22 whenever the axial spacing between the two segments 20, 22 is altered. Such alteration necessitates that the threading of one of the two segments 20, 22 follow and match the threading of the drive shaft 12. The variable axial spacing between the two carrier segments coupled with the adjustable threading of carrier segment 20 in effect is equivalent to a continuously threaded carrier segment of variable overall length "1".

Mounted on each unthreaded drive shaft section 16 are end stop cups 35 adjustably secured to the shaft by means of set screws 37 and each containing a return bias spring 36. The end stops 35 are adjustable along the shaft 12 and are positioned according to the axial length "1" of the carrier assembly 18 such that the assembly 18 may fully disengage from the shaft threading 34 at each unthreaded sections 16 while compressing the corresponding spring 36 into its cup 34 which thus applies a return bias to the carrier assembly 18 urging re-engagement of the load carrier assembly with the shaft threading 34. At these unthreaded sections, the carrier assembly 18 becomes disengaged from the threaded shaft section 14 as in FIG. 1 and remains axially stationary at this end-of-travel position irrespective of continued rotation of the drive shaft since the threaded segments 20, 22 of the carrier assembly rest on smooth, unthreaded portions of the drive shaft. The carrier assembly 18, however, becomes re-engaged with the threaded shaft section 14 upon reversal of the drive shaft's sense of rotation from the rotation sense which moved the carrier segment 18 to the particular end-of-travel position.

Figure 4:
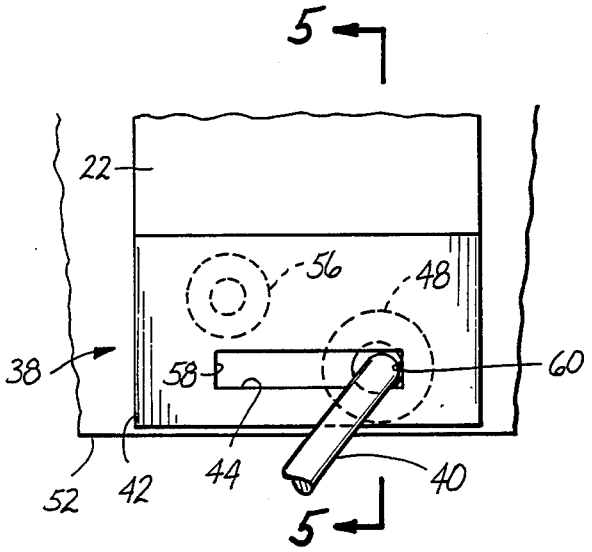
FIG. 4 is an enlarged longitudinal side view of the load coupling sub-assembly of the load carrier.
Figure 5:
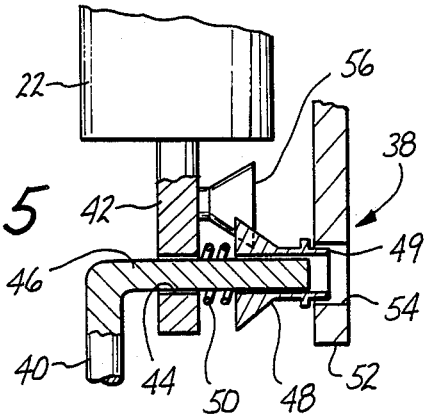
FIG. 5 is a cross-section taken along line 5—5 in FIG. 4.
Figure 6:
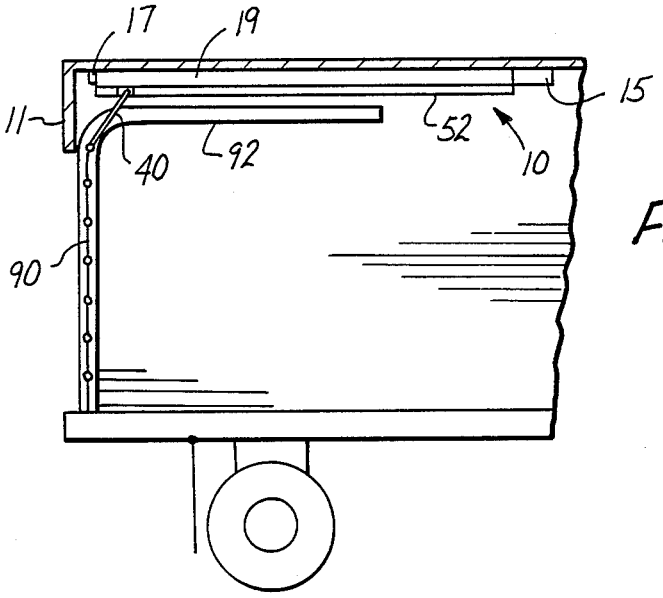
FIG. 6 shows a typical installation of the linear drive for operating a pull-up cargo van door.

A load coupling subassembly 38, best understood by reference to FIGS. 4 and 5 is affixed to the carrier segment 22. The coupling assembly 38 includes a plate 42 in which is defined a longitudinal slot 44. The lower end of a load connecting rod 40 is connected to a load such as a cargo van pull-up door 90 as illustrated in FIG. 6, and the upper end of the connecting rod 40 has a section 46 which is bent at a right angle to the rest of the rod 40. The transverse portion 46 extends through the slot 44 transversely to the plate 42 and is freely slideable between the two ends of the slot. A hollow pin 48 is axially slideable on the rod section 46 and is normally biased away from the plate 42 by a bias spring 50 interposed therebetween. The end 49 of the pin 48 is thus continuously urged against a wall 52 of the drive housing 19 which extends the full length of the drive shaft 12. In the wall 52 is defined a pin receiving hole 54 which becomes aligned with the load transfer and locking pin 48 at the left hand end-of-travel position of the carrier assembly 18. The pinhole 54 is aligned such that upon disengagement of the carrier assembly 18 at the right hand end-of-travel position, the load relief pin 48 moves under the urging of bias spring 50 axially into and is received by pinhole 54 thereby locking the upper end of the load connecting rod 40 to the housing wall 52 against any longitudinal movement within the slot 44. This has the effect of anchoring the load to the drive housing 19 and consequently to the structure to which the entire drive is fastened.

In FIG. 1, the load carrier assembly 18 is shown disengaged at its left hand end-of-travel position corresponding, in the example of FIG. 6, to a fully closed position of the cargo van folding door 90. During travel towards this position the pin 48 will have engaged in pinhole 54 and any axial force on the rod 40 is transmitted through the pin 48 to the fixture bracket 52 and ultimately to the drive supporting structure, e.g. the cargo van 11 in FIG. 6, thus relieving the drive system 10 of the load. The pin 48 also locks the load against movement and in particular it locks the cargo van door 90 in closed position against any manual attempt to forcibly lift and open the same. This is particularly important in that with large threading 34 on the drive shaft 12, it is possible to actually turn the drive shaft by pushing on the load so as to drive the load carrier assembly 18 along the shaft and thus gain unauthorized access into a cargo van interior or other structure. The load relief pin 48 thus not only mechanically protects the drive system 10 against unnecessary loading but also positively locks the load and secures the system against tampering and vandalism.

The coupling arrangement 38 operates to introduce a delay between threading re-engagement of the load carrier 18 with the drive shaft subsequent to engagement of the rod 19 with the carrier assembly 18 by a period equal to the time required by the carrier assembly 18 to travel the length of the slot 44 along the rotating drive shaft 12. This permits the shaft drive motor to reach full torque before the load connected to the rod 40 is applied to the drive mechanism and in particular to the drive motor.

The load release pin 56 cammingly engages the load locking pin 48 as the coupling plate 42 moves towards the threaded drive shaft portion 14 in FIG. 1. The two pins 48, 56 have oppositely tapered conical pinheads which are axially off-set from each other as best understood by reference to FIGS. 4 and 5, such that as the release pin 56 moves against the locking pin 48, an axial camming action is obtained which causes the locking pin 48 to withdraw from the pinhole 54 along shaft 46 against the urging of bias spring 50 thus freeing the rod 40 from the housing wall 52. After the aforementioned delay has elapsed the shaft 46 is then engaged by the left hand slot end 58 which then pulls the load connecting rod 40 along with the carrier assembly 18 along the length of the threaded drive shaft section 14 until the carrier segment 18 reaches the opposite, right hand end-of-travel position and again disengages from the drive shaft threading 34.

The load relief and locking feature of the coupling arrangement 38 as shown in the drawings is operative only for the left hand end-of-travel position shown in the drawings. For this feature to operate at both ends of the drive shaft, the release pin 56 would properly be relocated to a midpoint of the slot 44 or the arrangement otherwise modified in an appropriate fashion to achieve bi-directional automatic end-of-travel load locking and unlocking operation.

FIG. 10 illustrates in schematic form the operation of the linear drive mechanism 10 of FIG. 1. In FIG. 10*x*, the load carrier assembly 18 is at the right hand end-of-travel position of the drive system 10 and the load connecting rod 40 is at the left hand end 58 of the coupler plate slot 44, a position which in the example of FIG. 6 translates to the van door 90 being fully raised. Upon actuation of the drive motor 15 to turn the drive shaft 12 in an appropriate direction to cause re-engagement of the load carrier 18 with threaded shaft section 14, the load carrier 18 commences travel towards the left in the drawing. After a brief travel distance by the load carrier during which load connecting rod 40 remains stationary, the rod 40 is engaged by the right hand end 60 of the slot 44 at which point the load begins to move with the load carrier 18. In the example of FIG. 6, the van door 90 begins to lower, sliding in its guide tracks 92. The van door 90 continues to descend as the load carrier 18 and rod 40 travel fully across the threaded shaft section 14 as illustrated in FIG. 10*y* until the moment that carrier segment 22 comes off the left end of shaft thread 34, at which point axial movement of the load carrier ceases immediately, a condition illustrated in FIG. 10*z*, with the load connecting rod 40 against the right hand end 60 of the slot 44. The total travel distance of the load is determined by the beginning and ending positions of the load connecting rod transverse shaft 46, a distance "d" between beginning position d1 in FIG. 10*x* and ending position d2 in FIGS. 10*z*. The distance "d" is precisely repeatable for both directions of travel of the load carrier assembly 18. Because the distance traveled by the load is determined by purely mechanical means, the drive motor 15 may be controlled by a simple timer switch or any other convenient means which is operative for rotating the drive shaft a length of time sufficient to drive the load carrier 18 from one end-of-travel position to the other.

It will be apparent from the sequence 10*x*–10*z* that the right hand end-of-travel position of the load connecting rod, and consequently that of the load itself, is adjustable by adjustment of the axial spacing between the carrier segments 20, 22. If it is desired to make the left hand end-of-travel position adjustable the positions of the carrier segments 20, 22 may be reversed on the shaft 12. The choice of which end-of travel position is to be adjustable will depend on the particular application. For example, in the truck door actuating mechanism of FIG. 6, it may be desirable to provide for adjustment of the left hand end-of-travel position which corresponds to the lowered or closed position of the pull-up door 90, which is particularly critical in that precise, reliable and consistent alignment of door locks or latches must occur without on the other hand excessive lowering of the door which results in warping of and possible damage to the segmented door.

FIG. 7 shows an optional thread follower arrangement 70 attached to an alternative load carrier 18' consisting of a single threaded segment 22'. The thread follower 70 includes a cup housing 72 apertured to pass the drive shaft 12 and containing a thread follower spring 74 such as a split ring 74 seen in FIG. 10 which normally grips the drive shaft 12 within the shaft thread groove. The spring 74 is supported within the housing 72 in an inclined position matching the angle of shaft thread 34 by means of two positioning washers 84 each of which has a spacer tab 86. The two washers 84 hold the spring 74 between them. The spacer tabs 86 on the two washers point away from each other and are angularly spaced 180 degrees away from each other i.e., diametrically opposite on the shaft 12. The axial dimension of the thread follower housing 72 is such that the spacer tabs 84 cause the two washers 84 to lie at an angle corresponding to the thread angle of the drive shaft. As a result, the spring 74 is also held at the thread angle and thus follows the shaft thread 34. The axial position of the spring 74 is fixed in relation to the load carrier segment 22'. When the carrier segment 22' disengages at the end of the shaft thread 34 at the left hand end-of-travel position, the spring 74 remains in engagement with the shaft thread 34 because the carrier segment 22' comes into contact against a springless end stop 35' and is thus stopped against further axial travel which would otherwise occur after disengagement of the segment 22 until the spring 74 also disengaged from the shaft thread 34. This, however, is prevented by the end stop 35'. The spring 74 is thus unable to continue axial travel and the axial drive force exerted by the turning drive shaft thread 34 is resolved into a radially outward force causing the split ring 74 to spread open, resiliently yielding under this drive shaft force to disengage itself from the shaft thread 34. The spring 74 snaps open and shut with each turn of the drive shaft over each successive ridge or crest of the shaft thread 34, during which process the spring 74 maintains an axial driving force on the carrier segment 22', so as to maintain the carrier threading 32 in slightly spaced relationship away from the end of the drive shaft thread 34 and thereby prevents frictional wear of either the drive shaft or the carrier threading while the drive shaft is rotating in a direction tending to drive the load carrier away from the shaft threaded section 14. Upon subsequent reversal of the shaft rotation, the spring 74 maintains continuous engagement with the shaft thread 34 and pulls the carrier segment 22' towards the right into positive engagement with the threaded shaft section 14 to thus initiate travel of the load carrier 18' towards the opposite right hand unthreaded shaft section 16. The thread follower housing 72 may be packed with suitable grease as a reservoir of lubricant for the drive shaft 12 and spring 74.

A thread follower assembly 70 as in FIG. 7 may be provided on one or both sides of the load carrier 18', even though only one thread follower unit 70 is shown in the illustrated example. Also, the thread follower unit 70 may be substituted for the return bias spring 36 as was done in FIG. 7 at one or both ends of the drive shaft 12 since the thread follower unit performs the same function of bringing the carrier load unit 18 into reengagement with the shaft threading, and it is thus optional whether a bias spring 36 is used in conjunction with the thread follower unit 70.

While the described and illustrated linear drive systems have been shown to include a number of novel features and improvements which cooperate to provide reliable long term accuracy and performance, not all of these need to be included in any particular drive system. Rather, various combinations of the novel features here disclosed may be incorporated as needed. For example, the load carrier unit in the alternate drive system 10' of FIG. 7 may consist of a single carrier segment 22' lacking any axial adjustability but featuring the loose load coupling assembly 38 described in connection with FIGS. 4 and 5. In another alternative embodiment, the load connecting rod 40 may be fixedly connected to the axially segmented load carrier unit 18 illustrated. As already described, the thread follower unit 70 is an optional attachment to the load carrier and may be also used with the axially segmented carrier unit 18 of FIG. 1 as suggested there in dotted lining.

FIG. 9 shows an alternate follower spring 74' for use in the thread follower unit 70, consisting of two generally semicircular arms 94 hinged at 95 and on which are rotatable roller bearings 96. The arms 94 are normally held closed around the drive shaft 12 by spring 97. The follower spring arms 95 are spread apart against the force of spring 97 on the drive shaft 12 in a manner similar to the action of the split ring 74 in FIG. 8. Still other alternate configurations and arrangements for the follower spring 74 will become apparent to the art-skilled.

These and other changes, modifications and substitutions to the embodiment here illustrated will become apparent to those possessed of ordinary skill in the art without departing from the spirit and scope of the present invention which encompasses not only the embodiment of the invention described here for purposes of example and clarity, but all other mechanically equivalent embodiments as defined by the following claims.

What is claimed is:

1. A linear mechanical drive with precise end-of-travel load positioning comprising:

a drive shaft having a threaded portion intermediate two non-threaded portions;

motor drive means for reversibly turning said drive shaft;

a threaded load carrier including load connecting means axially displaceable on said shaft from one to another of said non-threaded portions responsive to rotation of said shaft, said carrier disengaging from said threaded portion at said non-threaded portions to thereby precisely determine the end-of-travel positions of the carrier irrespective of drive shaft rotation;

first means for bringing said carrier into reengagement with said threaded shaft portion at each of said non-threaded portions; and second means for adjusting at least one of the end-of-travel positions of said load connecting means in relation to the shaft axis.

2. The drive of claim 1 wherein said carrier comprises two axially connected threaded segments, said load connecting means being attached to one of said segments, and means for adjusting the axial spacing between said segments so as to vary the effective length of said carrier, thereby to achieve said load connecting means end-of-travel position adjustment.

3. The drive of claim 1 wherein said load connecting means is loosely coupled to said carrier to ensure reengagement of the carrier with said threaded portion and torque build-up of said drive motor means before a load is applied to said carrier.

4. The drive of claim 1 further comprising means for relieving said carrier of said load at one or both of said end-of-travel positions.

5. The drive of claim 1 wherein said first means comprise thread follower means on said carrier, said follower means remaining in engagement with said threaded shaft section after disengagement of said carrier at one or both of said non-threaded sections for bringing said carrier into reengagement with said threaded section upon rotation of said shaft in one sense and for maintaining said disengaged carrier spaced from said shaft threads to avoid thread wear during shaft rotation in the opposite sense.

6. The drive of claim 1 wherein said first means comprise bias spring means on one or both of said non-threaded sections of said shaft urging said carrier towards reengagement with said threaded section.

7. A linear mechanical drive with precise end-of-travel load positioning comprising:

a drive shaft having a threaded portion intermediate two non-threaded portions;

motor drive means for reversibly turning said drive shaft;

a threaded load carrier including load connecting means axially displaceable on said shaft from one to another of said non-threaded portions responsive to rotation of said shaft, said carrier disengaging from said threaded portion at said non-threaded portions to thereby precisely determine the end-of-travel positions of the carrier irrespective of drive shaft rotation; and thread follower means on said carrier, said follower means remaining in engagement with said threaded shaft section after disengagement of said carrier at one or both of said non-threaded sections for bringing said carrier into reengagement with said threaded section upon rotation of said shaft in one sense and for maintaining said disengaged carrier spaced from said shaft threads to avoid thread wear during shaft rotation in the opposite sense.

8. The drive of claim 7 further comprising bias spring means on said shaft urging said carrier towards reengagement with said threaded shaft portion at one or both of said end-of-travel positions.

9. The drive of claim 7 further comprising carrier stop means on said shaft and wherein said thread follower means yieldingly disengage from said shaft thread during shaft rotation urging said carrier against said stop means.

10. The drive of claim 9 wherein said thread follower means comprises means spring loaded into thread following engagement with said shaft, said means being driven out of said thread following engagement against said spring loading above a given axial load level applied by said drive shaft onto said bearing means.

11. A linear mechanical drive with precise end-of-travel load positioning comprising:

a drive shaft having a threaded portion intermediate two non-threaded portions;

motor drive means for reversibly turning said drive shaft;

a threaded load carrier including load connecting means axially displaceable on said shaft from one to another of said non-threaded portions responsive to rotation of said shaft, said carrier disengaging from said threaded portion at said non-threaded portions to thereby precisely determine the end-of-travel positions of the carrier irrespective of drive shaft rotation;

carrier stop means on said shaft;

thread follower means on said carrier comprising spring means in thread following engagement with said shaft, said spring means disengaging from said shaft thread during shaft rotation urging said carrier against said stop means, said follower spring means remaining in engagement with said threaded shaft section after disengagement of said carrier at one or both of said non-threaded sections for bringing said carrier into reengagement with said threaded section upon rotation of said shaft in one sense and for maintaining said disengaged carrier spaced from said shaft threads to avoid thread wear during shaft rotation in the opposite sense.

12. A linear mechanical drive with precise end-of-travel load positioning comprising:

a drive shaft having a threaded portion intermediate two non-threaded portions;

motor drive means for reversibly turning said drive shaft;

a threaded load carrier including load connecting means axially displaceable on said shaft from one to another of said non-threaded portions responsive to rotation of said shaft, said carrier disengaging from said threaded portion at said non-threaded portions to thereby precisely determine the end-of-travel positions of the carrier irrespective of continued drive shaft rotation;

first means for bringing said carrier into reengagement with said threaded shaft portion at each of said non-threaded portions;

said carrier comprising two axially connected threaded segments, said load connecting means being attached to one of said segments, and means for adjusting the axial spacing between said segments so as to vary the effective length of said carrier, thereby to adjust at least one of the end-of-travel positions of said load connecting means in relation to the shaft axis; and means for adjusting the threading on one of said segments in relation to the other of said segments thereby to match the shaft threading during said axial spacing adjustment.

13. A linear mechanical drive with precise end-of-travel load positioning comprising:

a drive shaft having a threaded portion intermediate two non-threaded portions;

drive shaft support means for mounting said drive shaft to a supporting structure;

motor drive means for reversibly turning said drive shaft;

a threaded load carrier including load connecting means axially displaceable on said shaft from one to another of said non-threaded portions responsive to rotation of said shaft, said carrier disengaging from said threaded portion at said non-threaded portions to thereby precisely determine the end-of-travel positions of the carrier irrespective of drive shaft rotation;

first means for bringing said carrier into reengagement with said threaded shaft portion at each of said non-threaded portions; and means for engaging said load connecting means to said supporting structure at one or both of said end-of-travel positions thereby to relieve said carrier of a load on said load connecting means while at said end-of-travel position.

14. The drive of claim 13 wherein said means for engaging comprise pin receiving means fixed to said supporting structure at one or both of said end-of-travel positions, pin means on said carrier biased towards engagement with said pin receiving means, pin releasing means on said carrier operative for disengaging said pin upon movement of said carrier towards reengagement with said threaded shaft section, and means for delaying operative engagement between said load connecting means and said carrier means until after disengagment of said pin and reengagement of said carrier with said threaded shaft section.

15. In a transport vehicle having a cargo enclosure and a pull-up type door slidable within guide tracks between a closed and an open position for access to the cargo enclosure, the improvement comprising:

a drive shaft rotatably mounted to said cargo enclosure, said shaft having a threaded portion intermediate two non-threaded portions;

motor drive means for reversibly turning said drive shaft;

a threaded load carrier including load connecting means connected to said door, said carrier being axially displaceable on said shaft between a first and a second of said non-threaded portions responsive to rotation of said shaft, said first position corresponding to said closed position of said door and said second position corresponding to said open position of said door;

said carrier disengaging from said threaded portion at said non-threaded portions to thereby precisely position said door at said closed and open positions irrespective of continued drive shaft rotation; and first means for bringing said carrier into reengagement with said threaded shaft portion at each of said non-threaded portions.

16. The improvement of claim 15 further comprising means associated with said load carrier means for adjusting one or the other of said positions of said door.

17. The improvement of claim 16 wherein said associated means comprise means for adjusting the effective axial dimension of said load carrier means.

18. The drive of claim 15 wherein said load connecting means is loosely coupled to said carrier means to ensure reengagement of the carrier with said threaded portion and torque build-up of said drive motor means before said carrier is loaded by said door.

19. The drive of claim 15 further comprising load relief means associated with said carrier means operative for engaging said door to said cargo enclosure against sliding movement in said guide tracks at one or both of said door positions thereby unloading said load carrier means and drive shaft at one or both of said end-of-travel positions.

20. The drive of claim 19 wherein said load relief means include mechanical means for freeing said door for sliding movement in said guide tracks responsive to movement of said load carrier means along said drive shaft.

* * * * *